US010436533B2

(12) United States Patent
Ferguson

(10) Patent No.: US 10,436,533 B2
(45) Date of Patent: Oct. 8, 2019

(54) MODULAR GUN HOUSING

(71) Applicant: United Tactical Systems, LLC, Lake Forest, IL (US)

(72) Inventor: Andrew William Ferguson, Taylorsville, NC (US)

(73) Assignee: United Tactical Systems, LLC, Lake Forest, IL (US)

( * ) Notice: Subject to any disclaimer, the term of this patent is extended or adjusted under 35 U.S.C. 154(b) by 0 days.

(21) Appl. No.: 15/870,222

(22) Filed: Jan. 12, 2018

(65) Prior Publication Data

US 2018/0202737 A1 Jul. 19, 2018

Related U.S. Application Data

(60) Provisional application No. 62/446,163, filed on Jan. 13, 2017.

(51) Int. Cl.

| | |
|---|---|
| ***F41A 11/02*** | (2006.01) |
| ***F41B 11/51*** | (2013.01) |
| ***F41C 23/16*** | (2006.01) |
| ***F41A 21/48*** | (2006.01) |
| ***F41A 3/66*** | (2006.01) |
| ***F41C 23/10*** | (2006.01) |
| *F41B 11/00* | (2013.01) |

(52) U.S. Cl.

CPC ..... *F41A 11/02* (2013.01); *F41A 3/66* (2013.01); *F41A 21/48* (2013.01); *F41C 23/10* (2013.01); *F41C 23/16* (2013.01); *F41B 11/00* (2013.01)

(58) Field of Classification Search

CPC ..... F41A 11/00; F41A 11/02; F41B 11/51; F41B 11/55; F41B 11/56; F41C 23/10; F41C 23/12; F41C 23/22; F41C 23/16

See application file for complete search history.

(56) References Cited

U.S. PATENT DOCUMENTS

| | | | | |
|---|---|---|---|---|
| 2,881,752 A * | 4/1959 | Blahnik | F41B 11/51 | 124/36 |
| 3,167,876 A * | 2/1965 | Milroy, Jr. | F41A 9/17 | 42/18 |
| 3,323,246 A * | 6/1967 | Loffler | F41A 11/00 | 192/13 A |
| 3,830,003 A * | 8/1974 | Clerke | F41C 23/00 | 42/71.01 |
| 5,048,215 A * | 9/1991 | Davis | F41A 35/06 | 42/71.01 |

(Continued)

*Primary Examiner* — Derrick R Morgan

(74) *Attorney, Agent, or Firm* — Barnes and Thornburg LLP

(57) ABSTRACT

A modular gun housing assembly is provided having a barrel body, a frame and a handle. The barrel body houses a firing bolt, a bolt spring and an air chamber. The frame has a cutaway to receive the barrel body and align the frame with the barrel body. The frame also has a bottom wall with a plurality of tabs extending therefrom to align the handle thereto. The frame is removably secured to the barrel body with a plurality of fasteners, and the handle is removably secured to the frame with a plurality of fasteners. The handle also has a plurality of mating receivers to engage and mate with the plurality of tabs extending from the frame. The handle also has a grip portion with a cavity to receive at least one of a projectile and a propellant container.

21 Claims, 10 Drawing Sheets

(56) References Cited

U.S. PATENT DOCUMENTS 5,293,708 A * 3/1994 Strayer ..... F41A 9/70 42/7
5,483,766 A * 1/1996 Hochstrate ..... F41C 23/10 42/71.02
5,736,667 A * 4/1998 Munostes ..... F41A 11/00 42/16
6,470,872 B1 * 10/2002 Tiberius ..... F41B 11/51 124/74
6,494,194 B2 * 12/2002 Shipachev ..... F41A 9/76 124/31
7,322,142 B1 * 1/2008 Leung ..... F41C 23/04 42/71.01
7,325,351 B1 * 2/2008 Leung ..... F41C 23/16 42/71.01
7,415,977 B2 * 8/2008 Chen ..... F41B 11/723 124/45
7,726,293 B2 * 6/2010 Wei ..... F41B 11/723 124/73
7,861,701 B1 * 1/2011 Wei ..... F41B 11/55 124/73
8,307,575 B1 * 11/2012 Battaglia ..... F41A 3/64 42/75.03
8,397,417 B2 * 3/2013 Jamison ..... F41A 21/485 42/75.03
8,935,871 B2 * 1/2015 Bardy ..... F41A 19/14 42/69.03
D728,726 S * 5/2015 Daniel ..... D22/108
10,260,828 B2 * 4/2019 Harrigan ..... F41A 3/66
2002/0139362 A1 * 10/2002 Shipachev ..... F41A 9/76 124/74
2005/0263147 A1 * 12/2005 Hatcher ..... F41A 11/02 124/31
2007/0144507 A1 * 6/2007 Hu ..... F41A 19/47 124/70
2008/0060247 A1 * 3/2008 Thomele ..... F41A 3/66 42/71.02
2008/0066729 A1 * 3/2008 Evans ..... F41B 11/62 124/73
2008/0105245 A1 * 5/2008 Cole ..... F41B 11/62 124/77
2009/0013578 A1 * 1/2009 Wang ..... F41A 19/46 42/70.08
2009/0277067 A1 * 11/2009 Gregg ..... F41A 3/66 42/69.01
2009/0320817 A1 * 12/2009 Huang ..... F41B 11/56 124/53
2010/0139144 A1 * 6/2010 Fitzpatrick ..... F41A 11/02 42/73
2011/0083653 A1 * 4/2011 Kawashima ..... F41B 11/55 124/57
2011/0120437 A1 * 5/2011 Tippmann, Jr. ..... F41B 11/55 124/74
2011/0259312 A1 * 10/2011 Wei ..... F41B 11/56 124/52
2012/0137563 A1 * 6/2012 Ubl ..... F41A 11/02 42/75.03
2012/0180360 A1 * 7/2012 Jones ..... F41A 11/02 42/75.03
2013/0014418 A1 * 1/2013 Dextraze ..... F41A 29/00 42/16
2013/0087130 A1 * 4/2013 Hu ..... F41B 11/721 124/60
2014/0137848 A1 * 5/2014 Kantonides ..... F41B 11/722 124/77
2014/0224235 A1 * 8/2014 Liao ..... F41A 11/00 124/32
2015/0285577 A1 * 10/2015 Faifer ..... F41A 23/10 42/94
2016/0033218 A1 * 2/2016 Folkestad, II ..... F41A 3/66 89/194
2016/0040948 A1 * 2/2016 Barrett ..... F41A 3/66 89/136
2016/0116252 A1 * 4/2016 Kincel ..... F41C 27/00 42/90
2016/0282082 A1 * 9/2016 Porat ..... F41C 23/10
2016/0290753 A1 * 10/2016 Sewell, Jr. ..... F41A 3/72
2017/0074616 A1 * 3/2017 Petersen ..... F41C 23/22
2017/0108310 A1 * 4/2017 Zimmerman ..... F41C 23/22
2017/0241724 A1 * 8/2017 Lammers ..... F41A 5/26
2017/0299297 A1 * 10/2017 Scalf ..... F41A 11/02
2017/0321980 A1 * 11/2017 Wolf ..... F41A 19/15
2018/0066905 A1 * 3/2018 Battaglia ..... F41A 3/66
2018/0202737 A1 * 7/2018 Ferguson ..... F41C 23/10
2018/0224233 A1 * 8/2018 MacY ..... F41A 19/12
2018/0224239 A1 * 8/2018 Noonan ..... F41C 23/22
2018/0259292 A1 * 9/2018 Schrock ..... F41C 23/10

* cited by examiner

MODULAR GUN HOUSING

CROSS-REFERENCE TO RELATED APPLICATIONS

This application claims the benefit of U.S. Provisional Patent Application No. 62/446,163, filed Jan. 13, 2017, which is expressly incorporated herein by reference and made a part hereof.

FEDERALLY SPONSORED RESEARCH OR DEVELOPMENT

Not Applicable.

TECHNICAL FIELD

The present disclosure relates generally to paintball guns, and more specifically to a modular housing for a paintball gun.

BACKGROUND

Paintball guns are well known in the art. While such guns according to the prior art provide a number of advantages, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY

According to one embodiment, the disclosed subject technology relates to a modular gun housing assembly having a barrel body, a frame and a handle. Different size and shaped handles, frames and barrel bodies can be connected to one another to form the overall gun housing.

The disclosed technology further relates to a modular gun housing assembly, comprising: a barrel body housing a firing bolt, a bolt spring and an air chamber; a frame removably secured to the barrel body, the frame having a front wall with a cutaway therein to receive and mate with a front portion of the barrel body, a rear wall with a cutaway therein to receive and mate with a rear portion of the barrel body, and a bottom wall having a grip opening and a trigger opening, a flange extending from the bottom wall adjacent the grip opening, the bottom wall further having a first protruding surface between the trigger opening and the front wall, and a second protruding surface between the grip opening and the rear wall; a handle removably secured to the frame, the handle comprising a grip portion and a trigger guard extending from the grip portion, a cavity in the grip portion to receive a magazine adapted to contain a plurality of projectiles the cavity also adapted to receive a propellant container, a recess in the cavity to receive and mate with the flange extending from the frame, and, the handle further having a first seating member to mate with the first protruding surface, and a second seating member to mate with the second protruding surface.

The disclosed technology further relates to a modular gun housing assembly, comprising: a barrel body; a frame having a cutaway to receive the barrel body and align the frame with the barrel body, the frame further having a bottom wall with a plurality of tabs extending therefrom, the bottom wall having a grip opening, wherein the frame is removably secured to the barrel body with a plurality of fasteners; and, a handle removably secured to the frame with a plurality of fasteners, wherein the handle has a plurality of mating receivers to engage and mate with the plurality of tabs extending from the bottom wall of the frame to align the handle with the frame, the handle further having a grip portion with a cavity therein to receive at least one of a projectile and a propellant container, and wherein the cavity of the grip portion is aligned with the grip opening in the frame.

The disclosed subject technology further relates to a modular gun housing assembly, comprising: a barrel body; a frame having a bottom wall having a grip opening, sidewalls extending upwardly from the bottom wall, and end walls connecting the sidewalls, wherein a first tab extends from the bottom wall between the grip opening and a front of the frame, wherein a second tab extends from bottom wall between the grip opening and a rear of the frame, wherein a flange extends from the bottom wall adjacent the grip opening, and wherein the frame is removably secured to the barrel body with a plurality of fasteners; and, a handle removably secured to the frame with a plurality of fasteners, the handle having a grip portion and a trigger guard extending from the grip portion, a cavity located within the grip portion to receive at least one of a projectile and a propellant container, the cavity of the grip portion being aligned with the grip opening in the frame, wherein the handle has a first mating receiver to engage and mate with the first tab, wherein the handle has a second mating receiver to engage and mate with the second tab, and wherein the cavity has a recess to mate with the flange extending from the frame.

The disclosed subject technology further relates to a modular gun housing assembly wherein the frame has a front wall and a rear wall, wherein the cutaway is provided in the front wall to receive and mate with a front portion of the barrel body, and wherein a second cutaway is provided in the rear wall to receive and mate with a rear portion of the barrel body.

The disclosed subject technology further relates to a modular gun housing assembly wherein the frame has a cutaway to receive the barrel body and align the frame with the barrel body. In one embodiment, the frame has a first cutaway in a first of the end walls to receive a front of the barrel body, and a second cutaway in a second of the end walls to receive a rear of the barrel body.

The disclosed subject technology further relates to a modular gun housing assembly of having a trigger opening in the bottom wall of the frame. In one embodiment a trigger assembly extends though the trigger opening in the frame.

The disclosed subject technology further relates to a modular gun housing assembly having a flange extending from the bottom wall of the frame adjacent the grip opening, and a recess in the cavity of the grip opening in the handle to mate with the flange extending from the frame.

The disclosed subject technology further relates to a modular gun housing assembly wherein the barrel body houses a firing bolt, a bolt spring and an air chamber.

The disclosed subject technology further relates to a modular gun housing assembly wherein different size handles can be secured to the frame.

The disclosed subject technology further relates to a modular gun housing assembly wherein the plurality of tabs extending from the bottom wall comprise a first tab extending from the bottom wall and a second tab extending from the bottom wall, and wherein the plurality of mating receivers of the handle comprises a first mating receiver to engage and mate with the first tab, and a second mating receiver to engage and mate with the second tab. In one embodiment, the first tab is located between the grip opening and a front of the frame, and the second tab is located between the grip opening and a rear of the frame. In another embodiment the tabs are different shapes.

The disclosed subject technology further relates to a modular gun housing assembly having a regulator to regulate pressurized air transferred from the propellant container to the air chamber.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below, serve to explain the principles of the disclosure.

DETAILED DESCRIPTION

Figure 1A:
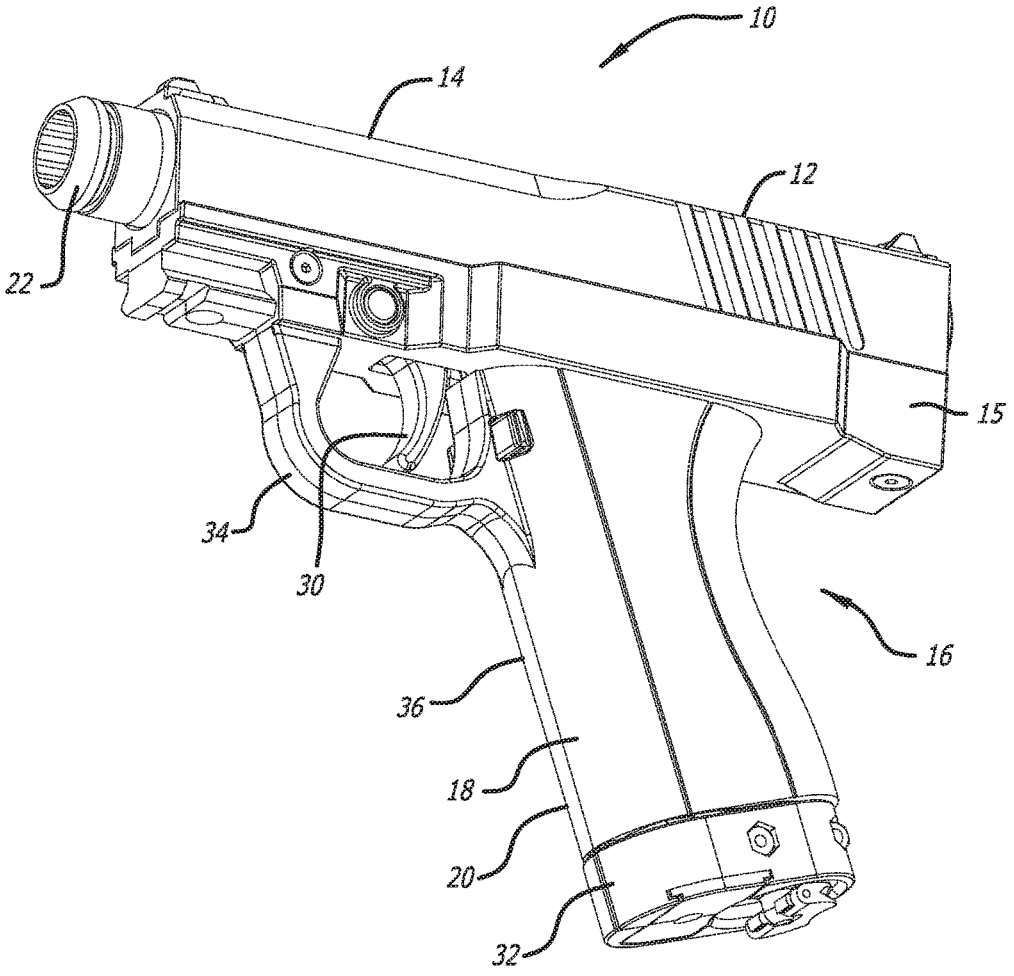
FIG. 1A is a perspective view of a gun according to one embodiment.

While the modular gun housing discussed herein is susceptible of embodiments in many different forms, there is shown in the drawings, and will herein be described in detail, preferred embodiments with the understanding that the present description is to be considered as an exemplification of the principles of the modular gun housing and are not intended to limit the broad aspects of the disclosure to the embodiments illustrated.

Figure 1B:
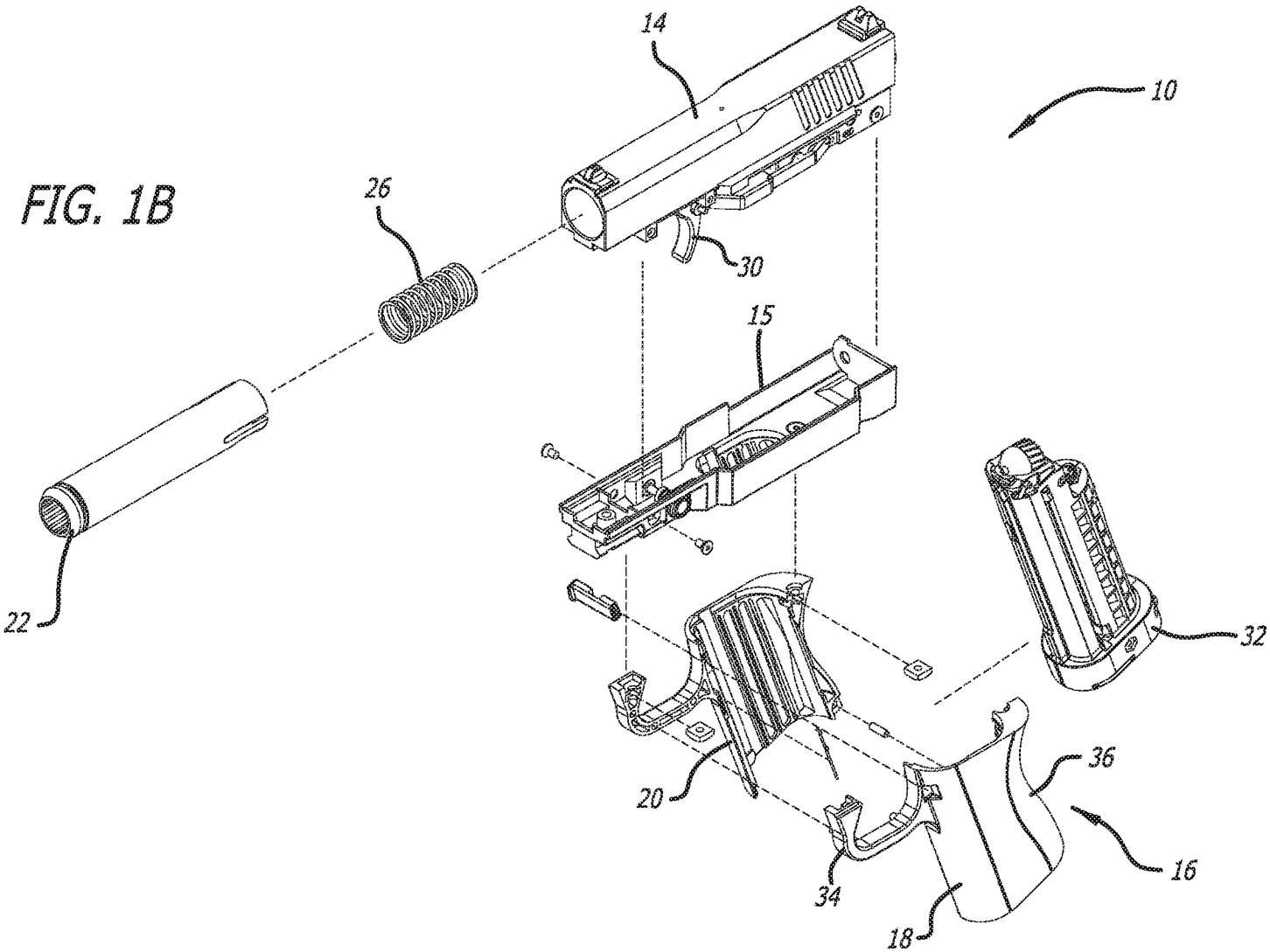
FIG. 1B is an exploded perspective view of the gun of FIG. 1.

Referring now to the figures, and initially to FIGS. 1A and 1B, in one embodiment there is shown a gun 10 for firing ammunition, such a paintball or other projectile, including a frangible projectile or a less lethal projectile. In one embodiment, as best shown in FIG. 1B, the gun 10 includes a housing assembly 12 comprised of a barrel body 14, a frame 15, and a handle assembly 16. In a preferred embodiment, the handle assembly 16 comprises a first handle portion 18 and a second handle portion 20. The first handle portion 18 is connected to the second handle portion 20, and the overall handle assembly 16 is preferably connected to the frame 15.

Figure 12:
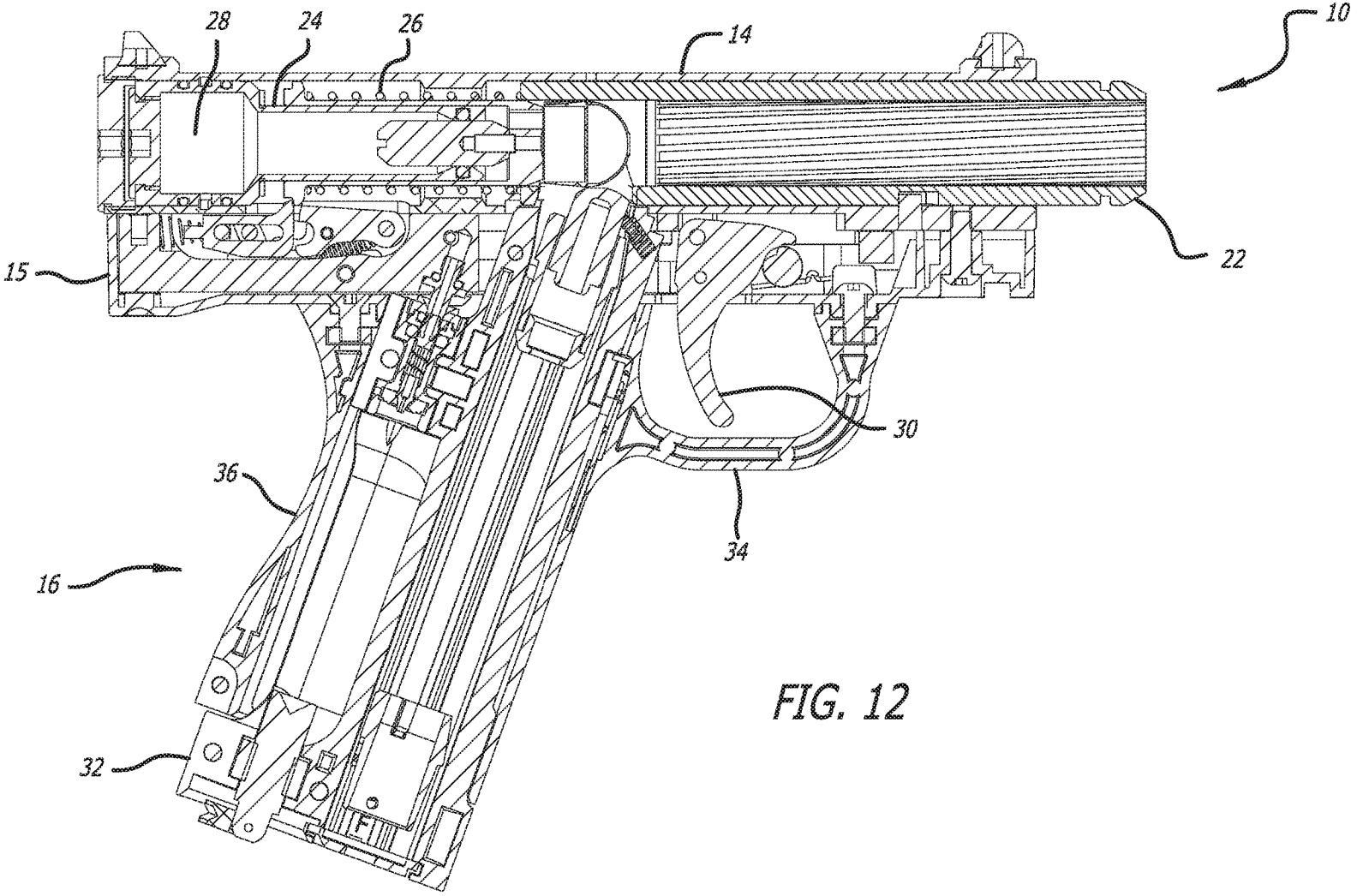
FIG. 12 is a cross-sectional view of one embodiment of a gun.
Figure 13:
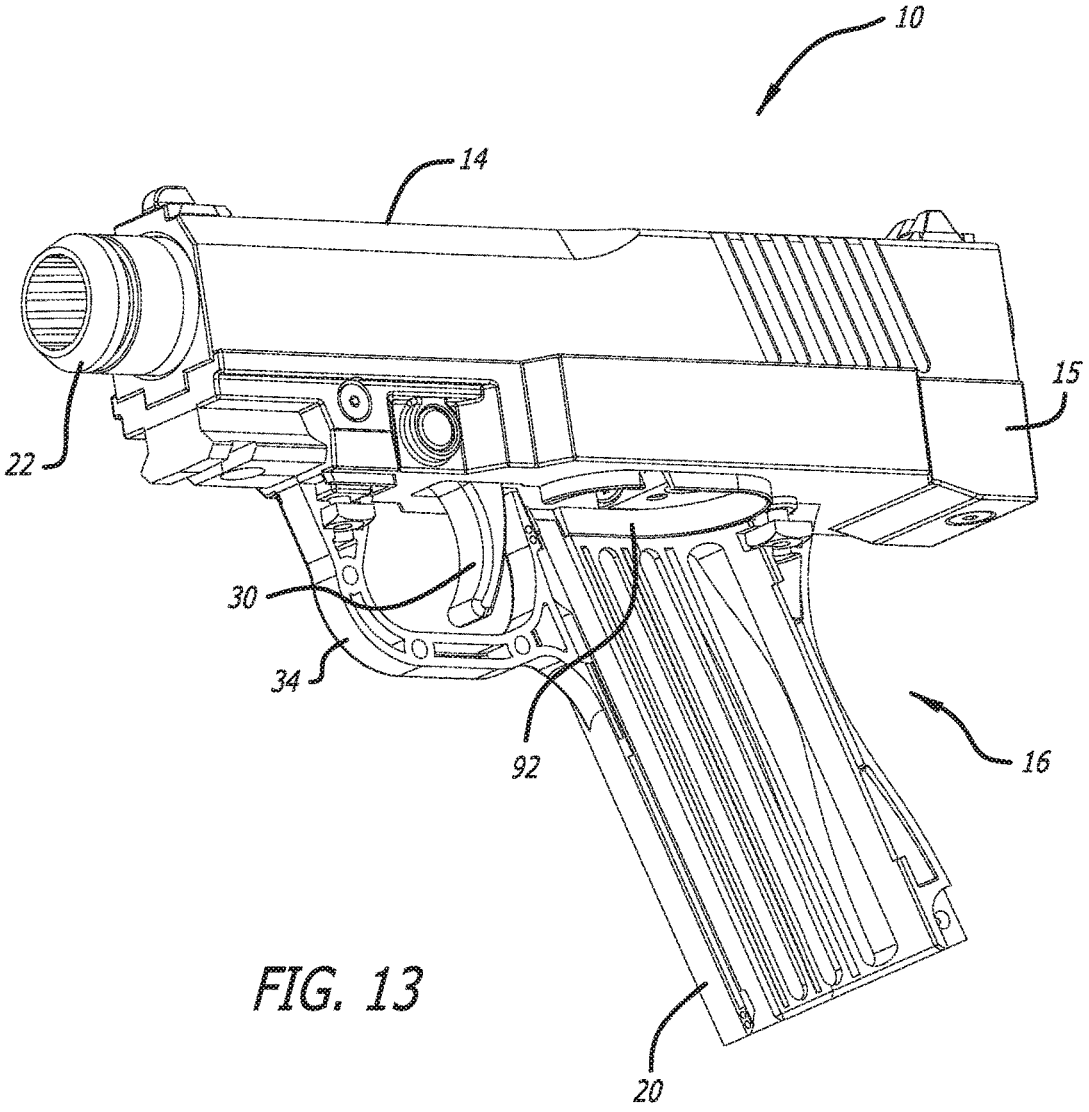
FIG. 13 is a perspective view of the gun of FIG. 12, with one half of the handle assembly removed.

In various embodiments, as shown in FIGS. 1B and 12, there may be several components within the barrel body 14 and/or the frame assembly 15, possibly including, but not limited to, a barrel 22, a firing bolt 24, a bolt spring 26, an air chamber 28, a regulator (not shown), and a trigger assembly 30, among other structures and assemblies commonly known to one of ordinary skill in the art.

Similarly, in various embodiments, within the handle assembly 16 there may be found a magazine 32 for holding the ammunition. Additionally, a propellant, such as a compressed gas, which provides energy to propel the ammunition from the gun 10, may be provided in a tank or cartridge (not shown) that is retained one of the magazine 32 or the handle assembly 16. Other structures and assemblies commonly known to one of ordinary skill in the art may also be found within the handle assembly 16. A trigger guard 34 may be integrally formed as part of the handle assembly 16 and extending from the grip portion 36 of the handle assembly 16. As explained above and as shown in FIG. 1B, in one embodiment, the handle assembly 16 may be comprised of a first handle portion 18 and a second handle portion 20 in a clamshell manner.

As shown in FIGS. 1B-11, in a preferred embodiment the frame 15 may be removed from the barrel body 14 and alternate embodiments of the frame 15 may be assembled to the barrel body 14. Similarly, the handle assembly 16 may be removed from the frame 15 and alternate embodiments of the handle assembly 16 may be secured to the frame 15. For example, different barrel bodies 14 may include different engines, different barrel sizes, different barrel colors, etc. Similarly, different handle assemblies 16 may allow for different size magazines, different handle angles, different handle sizes for different size hands of the user, different handle colors, different handle materials, etc. Additionally, by being able to swap out components the gun 10 may be changed from a right hand gun to a left hand gun, as well as having multiple other benefits. To properly mate the different components (e.g., the barrel body 14, frame 15 and handle assembly 16) with each other, the components (e.g., barrel body, 14, frame 15 and handle assembly 16) have various combinations of tabs or mating members and mating receivers. In addition to the mating members and mating receivers used to properly align the components, a plurality of fasteners are used to secure the components together.

Figure 2:
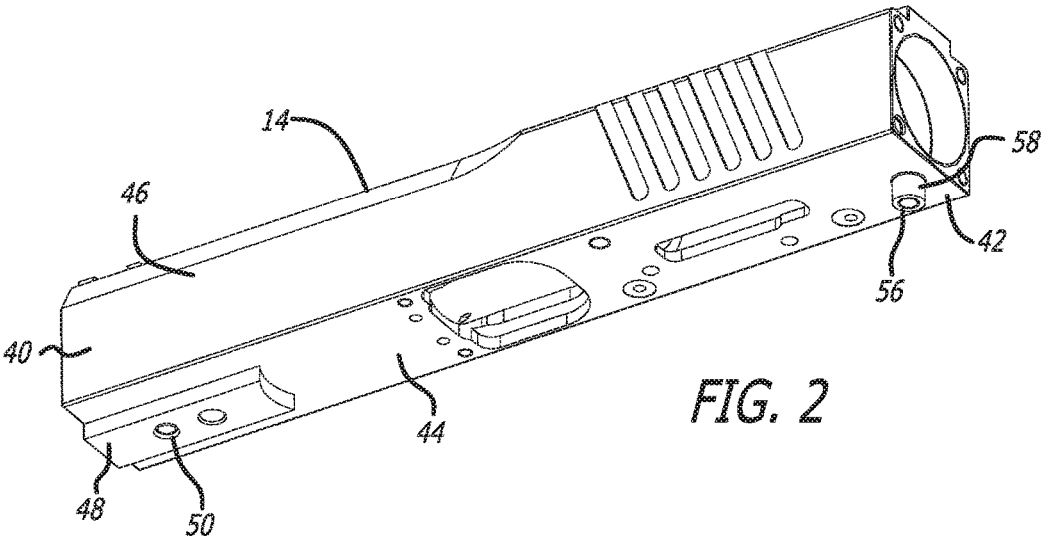
FIG. 2 is a bottom perspective view of one embodiment of a barrel housing for the gun of FIG. 1.
Figure 3:
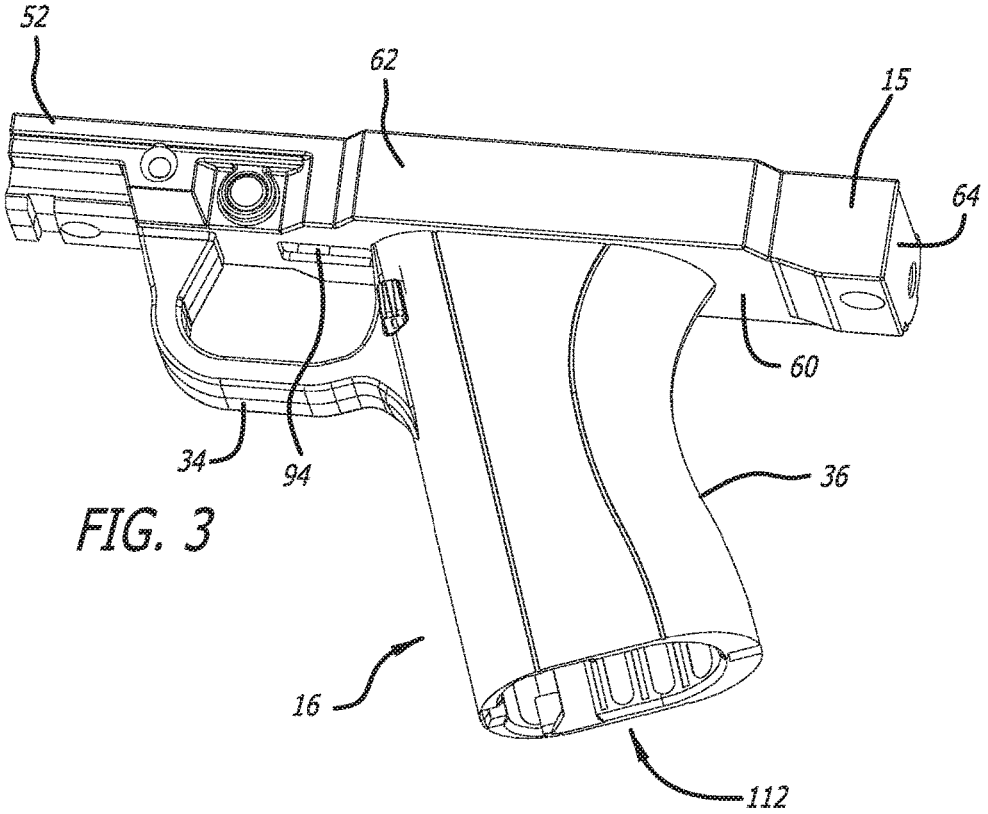
FIG. 3 is a perspective view of one embodiment of a handle and frame assembly for the gun of FIG. 1.
Figure 4:
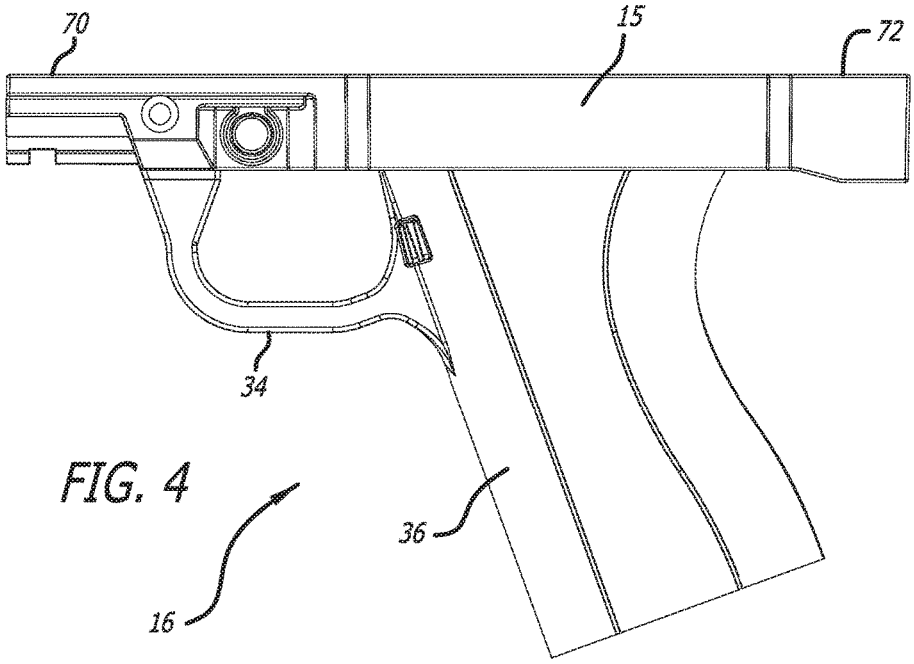
FIG. 4 is a side view of the handle and frame assembly of FIG. 3.
Figure 5:
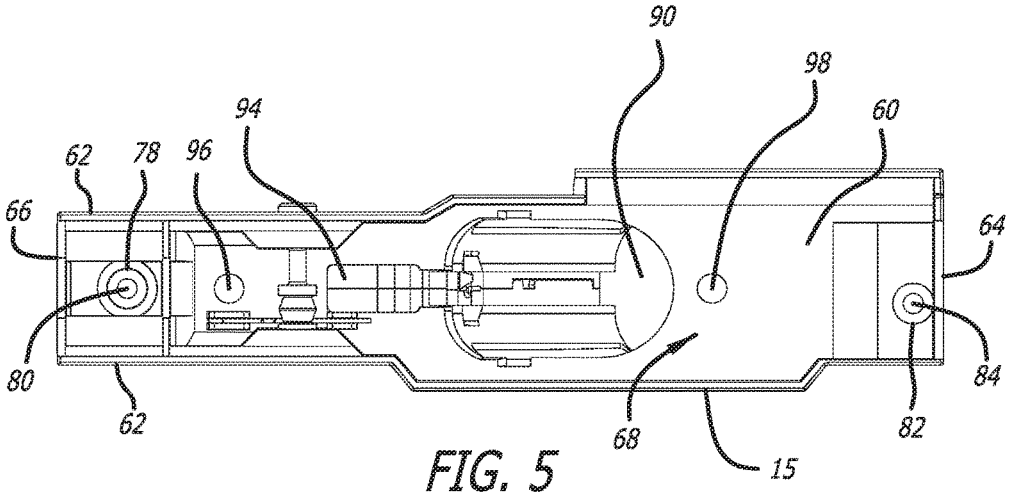
FIG. 5 is a top view of the handle and frame assembly of FIG. 3.
Figure 6:
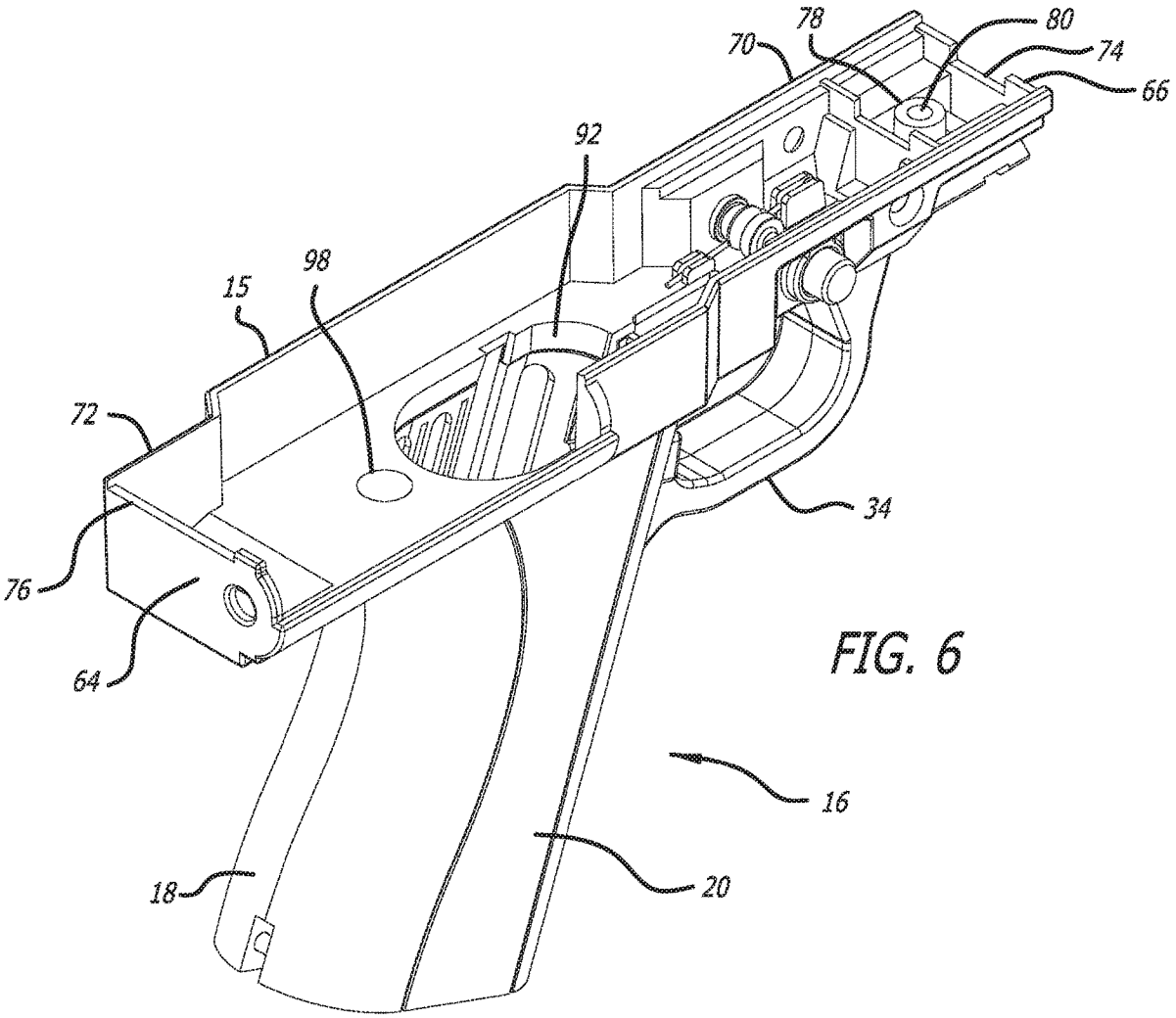
FIG. 6 is a top perspective view of the handle and frame assembly of FIG. 3.
Figure 7:
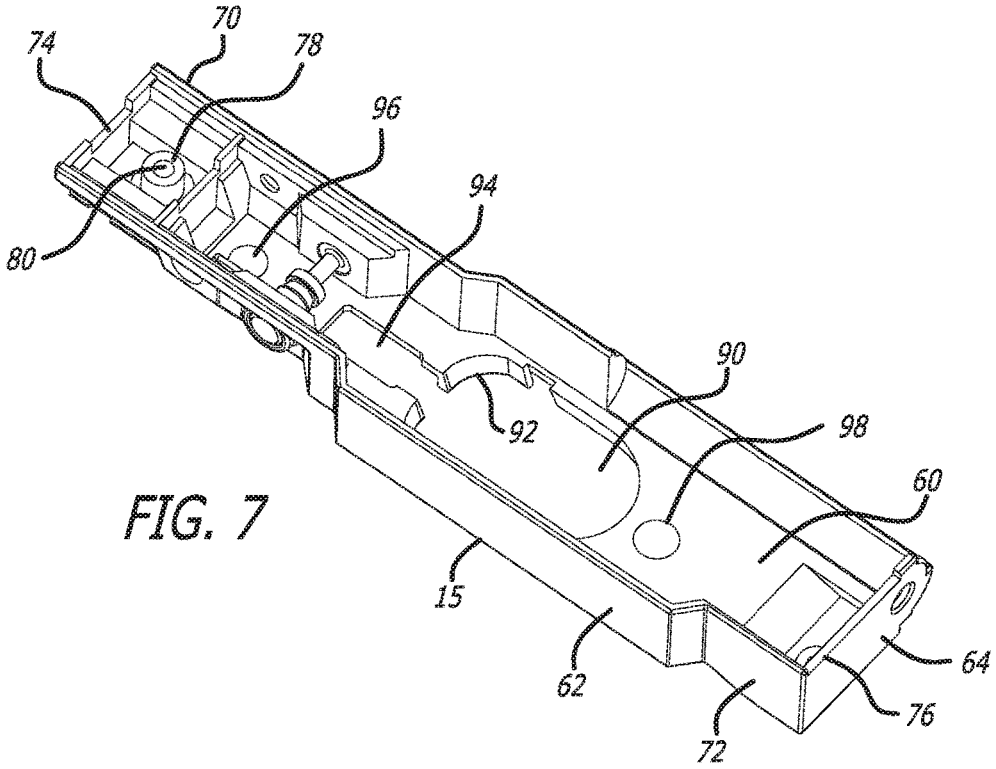
FIG. 7 is a top perspective view of the frame assembly of FIG. 3.
Figure 8:
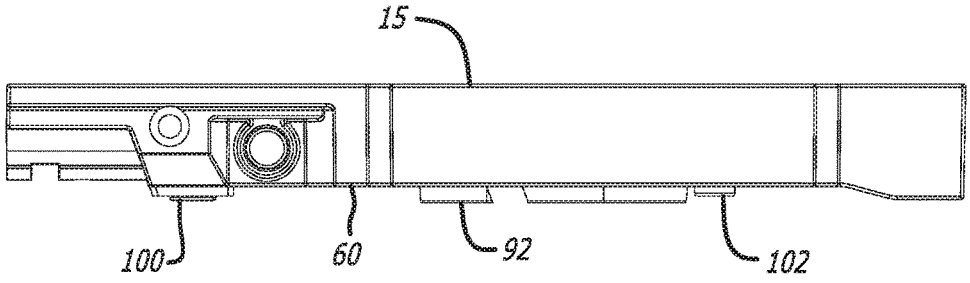
FIG. 8 is a side view of the frame assembly of FIG. 3.
Figure 9:
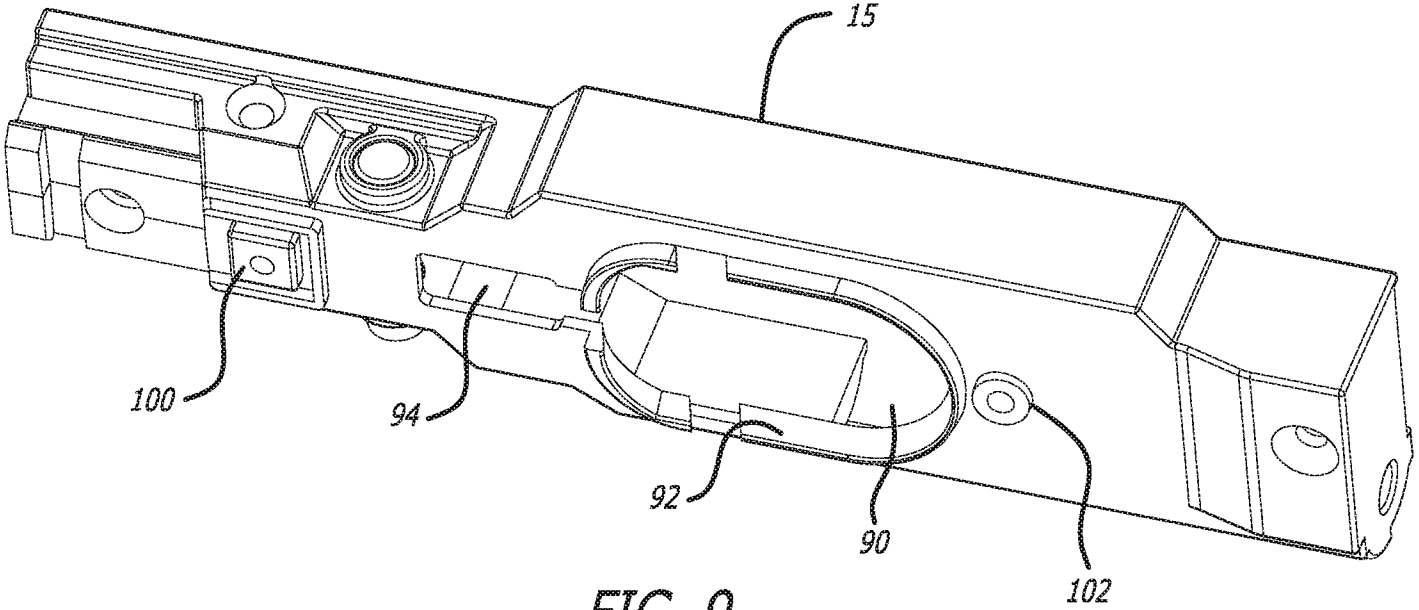
FIG. 9 is a bottom perspective view of the frame assembly of FIG. 3.

In one embodiment, as shown in FIGS. 1A, 1B and 2, the barrel body 14 generally comprises an elongated shape with an exit or front end 40 and a back or rear end 42. The end of the barrel body 14 where the projectile exits from the barrel body following firing of the gun 10 is generally referred to as the front end 40. In one embodiment, the front end 40 of the barrel body 14 has a generally flat bottom wall 44 and vertical sidewalls 46 extending upwardly therefrom. Additionally, in one embodiment a protrusion or step down 48 may be provided on the bottom wall 44 of the barrel body 14 toward the front end 40 of the barrel body 14. A receiver 50 may be provided in the bottom wall 44 of the barrel body 14 toward the front end 40, including in the step down 48, to receive a fastener to connect a front end 52 of the frame 15 to the front end 40 of the barrel body 14. In one embodiment, the receiver 50 may be threaded to receive a bolt.

The back end 42 of the barrel body 14 also preferably has generally flat bottom wall 44 and vertical sidewalls 46 extending upwardly therefrom. In one embodiment, the bottom wall 44 at the back end 42 is the same wall as the bottom wall 44 at the front end 40 of the barrel body 14. Alternately, however, the bottom wall at the back end 42 may be co-planar, in the same plane, or may be in a different plane and be a different wall than the bottom wall 44 at the front end 40 of the barrel body 14. Additionally, a receiver 56 may be provided in the bottom wall 44 of the barrel body 14 toward the rear end 42. In one embodiment, the receiver 56 is provided in a boss 58 extending from the bottom wall 44 of the barrel body 14. In one embodiment, the receiver 56 may be threaded to receive a bolt.

As shown in FIGS. 1B and 3-9, the frame 15 generally comprises an elongated body having a bottom wall 60, side walls 62, a rear wall 64, and a front wall 66 to define a cavity 68. Like the barrel body 14, the frame 15 also has a front end 70 and a back or rear end 72. The end of the frame 15 adjacent the front end 40 of the barrel body 14 where the projectile exits from the barrel body 14 following firing of the gun 10 is generally referred to as the front end 70 of the frame 15. In one embodiment, the front wall 66, also referred to as an end wall, has a cutaway 74 to mate with and receive the front end 40 of the barrel body 14, including the step down 48 in the barrel body 14. Additionally, in one embodiment the rear wall 64, similarly also referred to as an end wall, has a cutaway 76 to mate with and receive the rear end 42 of the barrel body 14.

Further, in one embodiment the frame 15 may have a boss 78 toward the front end 70 of the frame 15. The boss 78 preferable has an aperture 80 there through to allow a fastener to be extended through the boss 78. When the frame 15 and barrel body 14 are properly aligned, a fastener can be placed through the aperture 80 in the boss 78 and the fastener is able to mate with the receiver 50 in the bottom wall 44 of the front end 40 of the barrel body 14. In the preferred embodiment where the receiver 50 is threaded, the fastener that extends through the aperture 80 in the boss 78 is able to secure the front end 70 of the frame 15 to the barrel body 14.

Similarly, in one embodiment the frame 15 may also have a boss 82 with an aperture 84 there through toward the rear end 72 of the frame 15. When the frame 15 and the barrel body 14 are properly aligned, a fastener can be placed through the aperture 84 and the fastener is able to mate with the receiver 56 in the bottom wall 54 of the barrel body 14 toward the rear end 42. In the preferred embodiment where the receiver 56 is threaded, the fastener that extends through the aperture 84 in the boss 82 at the rear end 72 of the frame 15 is able to secure the rear end 72 of the frame 15 to the barrel body 14.

In one embodiment, as best shown in FIGS. 5-9, the bottom wall 60 of the frame 15 has a grip opening 90 for receiving the handle assembly 16 and magazine 32 that may be provided in the handle assembly 16. Adjacent the grip opening 90 is a rib or flange 92 that extends from the bottom wall 60 and that is used to engage an interior wall of the handle assembly 16 to properly seat the handle assembly 16 with the frame 15. The bottom wall 60 of the frame 15 also has a trigger opening 94 for allowing the trigger assembly 30 to extend out of the frame 15 and be positioned adjacent the trigger guard 34 of the handle assembly 16.

The frame 15 preferably also has apertures 96, 98 for fasteners to pass through to secure the frame 15 to the handle assembly 16. In one embodiment, a first aperture 96 is provided adjacent the trigger opening 94 and a second aperture 98 is provided adjacent the grip opening 90. Additionally, adjacent each of the apertures 96, 98 are protruding surfaces 100, 102, also referred to as tabs, such as bosses, that extend away from the bottom wall 60 of the frame 15. The geometry of the protruding surfaces or tabs 100, 102, respectively, mates with openings 104, 106, respectively, of the handle assembly 16 to properly align the handle assembly 16 to the frame 15. Accordingly, when protruding surface 100 adjacent the trigger opening 94 is properly seated in the mating opening 104 in the trigger guard 30 of the handle assembly 16, and when protruding surface 100 adjacent the grip opening 90 is properly seated in the mating opening 106 of the handle assembly 16, fasteners can be placed through the apertures 96, 98 in the frame 15 to be mated with the fastener receivers 108, 110, respectively, within the openings 104, 106, respectively, of the handle assembly 16. Preferably the fastener receivers 108, 110 are threaded or have threaded members associated therewith (see FIGS. 6 and 10-12).

Referring to the handle assembly 16 shown in FIGS. 10-13, in one embodiment, the handle assembly 16 may be comprised of a first handle portion 18 and a second handle portion 20 that are combined together in a clamshell manner to form the overall handle assembly 16. The overall handle assembly 16 generally comprises a grip portion 36 and an integral trigger guard 34 extending from the grip portion 36. An opening or cavity 112 is provided within the grip portion 36 of the handle assembly 16. The opening 112 may be a through opening extending from one end of the grip portion to the other end of the grip portion, or one end of the grip portion may be closed and the opening 112 may operate more like a cavity 112. In one embodiment, the opening 112 is provided to allow a magazine for holding ammunition to be inserted therein. Additionally, a propellant, such as a compressed gas, which provides energy to propel the ammunition from the gun 10, may be provided in a tank or cartridge (not shown) that is retained one of the magazine 32 or the opening 112 in the handle assembly 16. As explained herein and known to those of skill in the art, other structures and assemblies commonly known to one of ordinary skill in the art may also be found within the handle assembly 16.

Figure 10:
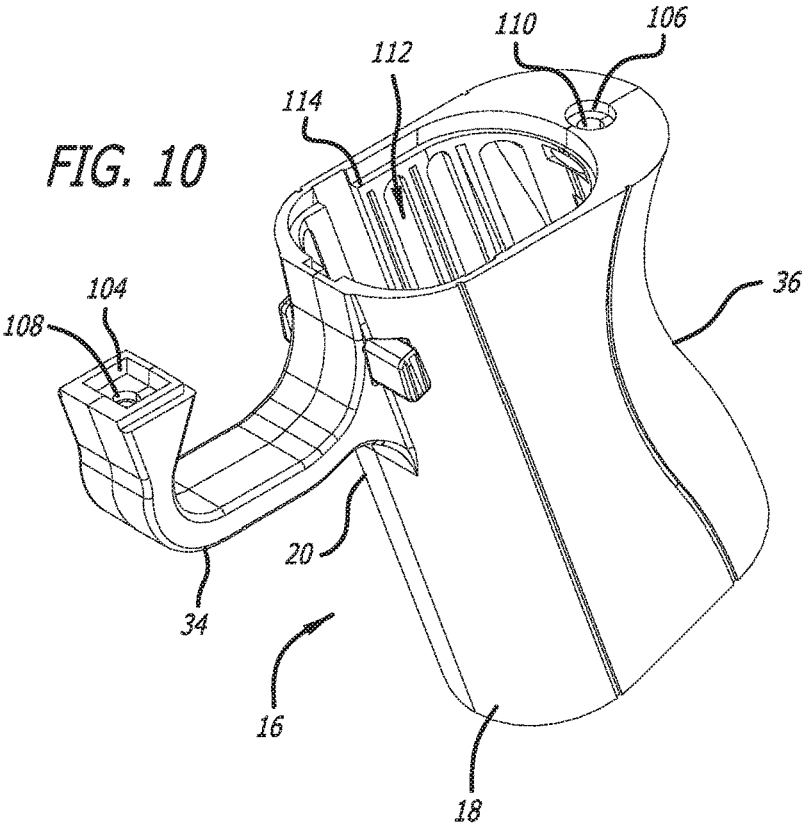
FIG. 10 is a top perspective view of the handle assembly of FIG. 3.
Figure 11:
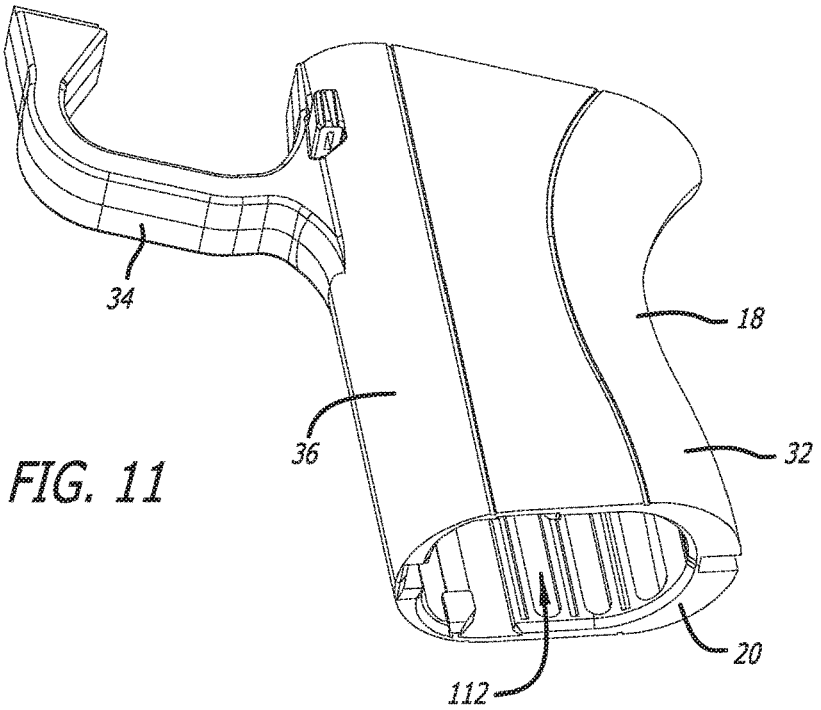
FIG. 11 is a bottom perspective view of the handle assembly of FIG. 3.

As discussed herein, the handle assembly 16 is preferably secured to the frame 15. In one embodiment there are two fasteners that are used to secure the handle assembly 16 to the frame 15. Additionally, there are preferably three different mating members to properly align and seat the handle assembly and the frame 15 prior to the fasteners being secured. The first seating/aligning member is the first opening 104 that is provided in the handle assembly 16 at the end of the trigger guard 34 to receive the protruding surface/tab 100 adjacent the trigger opening 94 of the frame 15. The second seating/aligning member is the second opening 106 that is provided in the handle assembly 16 adjacent the opening 112 in the handle assembly 16 to receive the protruding surface/tab 102 toward the rear end 72 of the frame 15. The third seating/aligning member is a recess 114 within the opening 112 in the handle assembly 16. In one embodiment, as shown in FIG. 10, the rib/flange 92 that extends from the bottom wall 60 of the frame 15 mates with the recess 114 in the interior wall of the opening 112 to assist in properly seating the handle assembly 16 with the frame 15.

The modular gun housing 10 allows for a variety of handle assemblies 16 to be able to be connected to the variety of frames 15 and a variety of barrel bodies 14. In this manner, different size grip portions 36 of the handle assembly 16 may be provided for different size hands of the user. Additionally, since the barrel body 14, frame 15 and handle assembly 16 may be removed and replaced, different materials, different size components, different color schemes, and different constructions may be provided together in a variety of combinations. Similarly, the modular and replaceable handle assembly allows for different handle assemblies to accommodate different magazines for different projectiles and for different quantities of projectiles.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A modular gun housing assembly, comprising:

a barrel body housing a firing bolt, a bolt spring and an air chamber;

a frame removably secured to the barrel body in a fixed position, the frame having a front wall with a cutaway therein to receive and mate with a front portion of the barrel body, a rear wall with a cutaway therein to receive and mate with a rear portion of the barrel body, and a bottom wall having a grip opening and a trigger opening, a flange extending from the bottom wall adjacent the grip opening, the bottom wall further having a first protruding surface extending away from the bottom wall and positioned between the trigger opening and the front wall, and a second protruding surface extending away from the bottom wall and positioned between the grip opening and the rear wall; and, a handle removably secured to the frame, the handle comprising a grip portion and a trigger guard extending from the grip portion, a cavity in the grip portion to receive a magazine adapted to contain a plurality of projectiles the cavity also adapted to receive a propellant container, a recess in the cavity to receive and mate with the flange extending from the frame, and, the handle further having a first seating member formed into the trigger guard of the handle and configured to mate with the first protruding surface for alignment of the handle relative to the frame, a first fastener extending through the first seating member, a second seating member formed into the grip of the handle and configured to mate with the second protruding surface for alignment of the handle relative to the frame, and a second fastener extending through the second seating member.

2. The modular gun housing assembly of claim 1, further comprising a regulator to regulate pressurized air transferred from the propellant container to the air chamber.

3. The modular gun housing assembly of claim 1, further comprising a trigger assembly extending though the trigger opening in the frame.

4. The modular gun housing assembly of claim 1, wherein different size handles can be secured to the frame.

5. A modular gun housing assembly, comprising:

a barrel body;

a frame having a cutaway to receive the barrel body and align the frame with the barrel body, the frame further having a bottom wall with a plurality of tabs extending therefrom, the bottom wall having a grip opening; and, a handle having a plurality of mating receivers recessed into the handle to engage and mate with the plurality of tabs extending from the bottom wall of the frame to align the handle with the frame, the handle further having a grip portion with a cavity therein to receive at least one of a projectile and a propellant container, wherein a first plurality of fasteners extend through the frame and into the barrel body to removably secure the barrel body to the frame, a second plurality of fasteners extend through the frame and into the handle to removably secure the handle to the frame, and the cavity of the grip portion is aligned with the grip opening in the frame when the handle is secured to the frame.

6. The modular gun housing assembly of claim 5, wherein the frame has a front wall and a rear wall, wherein the cutaway is provided in the front wall to receive and mate with a front portion of the barrel body, and wherein a second cutaway is provided in the rear wall to receive and mate with a rear portion of the barrel body.

7. The modular gun housing assembly of claim 5, further comprising a trigger opening in the bottom wall of the frame.

8. The modular gun housing assembly of claim 7, further comprising a trigger assembly extending though the trigger opening in the frame.

9. The modular gun housing assembly of claim 5, further comprising a flange extending from the bottom wall of the frame adjacent the grip opening, and a recess in the cavity of the grip opening in the handle to mate with the flange extending from the frame.

10. The modular gun housing assembly of claim 5, wherein the barrel body houses a firing bolt, a bolt spring and an air chamber.

11. The modular gun housing assembly of claim 5, wherein different size handles can be secured to the frame.

12. The modular gun housing assembly of claim 5, wherein the plurality of tabs extending from the bottom wall comprise a first tab extending from the bottom wall and a second tab extending from the bottom wall, and wherein the plurality of mating receivers of the handle comprises a first mating receiver to engage and mate with the first tab, and a second mating receiver to engage and mate with the second tab.

13. The modular gun housing assembly of claim 12, wherein the first tab is located between the grip opening and a front of the frame, and wherein the second tab is located between the grip opening and a rear of the frame.

14. The modular gun housing assembly of claim 5, wherein the handle further comprises a trigger guard extending from the grip portion.

15. A modular gun housing assembly, comprising:

a barrel body;

a frame having a bottom wall having a grip opening, sidewalls extending upwardly from the bottom wall, and end walls connecting the sidewalls, wherein a first tab extends from the bottom wall between the grip opening and a front of the frame, wherein a second tab extends from bottom wall between the grip opening and a rear of the frame, wherein a flange extends from the bottom wall adjacent the grip opening; and, a handle having a grip portion and a trigger guard extending from the grip portion, a cavity located within the grip portion to receive at least one of a projectile and a propellant container, the cavity of the grip portion being aligned with the grip opening in the frame, wherein the handle has a first mating receiver recessed into the handle to engage and mate with the first tab, wherein the handle has a second mating receiver recessed into the handle to engage and mate with the second tab, wherein a first plurality of fasteners extend through the frame and into the barrel body to removably secure the barrel body to the frame, a second plurality of fasteners extend through the frame and into the handle to removably secure the handle to the frame, the cavity of the grip portion is aligned with the grip opening in the frame when the handle is secured to the frame, and a recess is formed into the handle in the cavity and configured to mate with the flange of the frame.

16. The modular gun housing assembly of claim 15, wherein the barrel body houses a firing bolt, a bolt spring and an air chamber.

17. The modular gun housing assembly of claim 15, wherein the tabs are different shapes.

18. The modular gun housing assembly of claim 15, wherein different size handles can be secured to the frame.

19. The modular gun housing assembly of claim 15, wherein the frame has a cutaway to receive the barrel body and align the frame with the barrel body.

20. The modular gun housing assembly of claim 15, wherein the frame has a first cutaway in a first of the end walls to receive a front of the barrel body, and wherein the frame has a second cutaway in a second of the end walls to receive a rear of the barrel body.

21. The modular gun housing assembly of claim 15, further comprising a trigger opening in the bottom wall of the frame.

* * * * *